US005797287A

United States Patent [19]

Prunbauer

[11] Patent Number: 5,797,287

[45] Date of Patent: Aug. 25, 1998

[54] FLAT KEY

[75] Inventor: Kurt Prunbauer, Herzogenburg, Austria

[73] Assignee: Evva-Werk Spezialerzeugung von Zylinder- und Sicherheitsschlossern Gesellschaft m.b.H. & Co. KG, Vienna, Austria

[21] Appl. No.: 593,120

[22] Filed: Feb. 1, 1996

[30] Foreign Application Priority Data

Feb. 1, 1995 [AT] Austria ..... 177/95

[51] Int. Cl.[6] ..... E05B 19/06

[52] U.S. Cl. ..... 70/409; 70/406; 70/358

[58] Field of Search ..... 70/405, 406, 409, 70/421, 420, 358

[56] References Cited

U.S. PATENT DOCUMENTS

| | | | |
|---|---|---|---|
| 1,193,412 | 8/1916 | Nelson | 70/420 |
| 3,742,744 | 7/1973 | Lumme | 70/421 |
| 4,320,638 | 3/1982 | Dunphy et al. | 70/409 |
| 4,434,636 | 3/1984 | Prunbauer | 70/421 |
| 4,612,787 | 9/1986 | Prunbauer et al. | 70/409 |
| 4,723,427 | 2/1988 | Oliver | 70/409 |
| 5,287,712 | 2/1994 | Sieg | 70/409 |
| 5,289,709 | 3/1994 | Field | 70/409 |
| 5,438,857 | 8/1995 | Kleinhaeny | 70/409 |

FOREIGN PATENT DOCUMENTS

| | | | |
|---|---|---|---|
| 395262 | 11/1992 | Austria . | |
| 1171680 | 7/1984 | Canada | 70/222 |
| 0237172 | 9/1987 | European Pat. Off. . | |
| 2931653 | 2/1981 | Germany | 70/409 |
| 614262 | 11/1979 | Switzerland . | |
| WO 93/093317 | 5/1993 | WIPO . | |

OTHER PUBLICATIONS

DEGM 295 93 514.5, EVVA DPX 3Profil–System +Stift–System, Hengelo (NL)–Prag–Budapest, brochure–6 pages 2 Mar. 1995.

*Primary Examiner*—Darnell M. Boucher
*Attorney, Agent, or Firm*—Herbert Dubno; Andrew Wilford

[57] ABSTRACT

A key has a flat key body having a blade extending along a longitudinal insert axis and having a front edge formed with transversely directed bitting, an opposite longitudinally extending back edge, and a pair of oppositely directed faces. Each face is formed with at least two longitudinally extending front grooves extending adjacent the front edge a full length of the blade and having depths equal to more than half of a transverse thickness of the blade, a longitudinally extending back groove having a floor at a depth equal to less than half of the blade thickness, and an elongated angled groove extending at an acute angle to and across the respective back groove at an intersection and having a part-cylindrical floor aligned with and forming a smooth continuation of the floor of the respective back groove at the intersection. The angled groove of the one face extends nonparallel to the angled groove of the other face, that is axes of the angled grooves on one face are all parallel to each other and cross similar axes of the grooves on the other face.

3 Claims, 8 Drawing Sheets

FLAT KEY

FIELD OF THE INVENTION

The present invention relates to a flat key. More particularly this invention concerns such a key which is designed to provide a particularly great number of different bittings.

BACKGROUND OF THE INVENTION

European patent document WO93/09317 describes a lock system including a flat key having a blade extending along a longitudinal insert axis, having an edge formed with bitting, and having a pair of faces at least one of which is formed with at least one longitudinally extending main groove, and at least one bit groove shorter than the main groove and extending at an acute angle to the main groove. A lock core rotatable in a lock housing has a passage complementary to the key blade and formed with a longitudinally extending ridge complementarily engageable in the main groove. The key blade fits along the axis into the passage. Primary tumblers displaceable transversely in the core are engageable transversely with the bitting of the key blade in the passage and a secondary tumbler element in the core has a feeler end and is displaceable transversely in the core and housing between an inner position with the end engaged complementarily transversely in the bit groove of the key blade in the passage and the element permitting relative rotation of the core and housing and an outer position with the end not engaged in the bit groove and the element preventing relative rotation of the core and housing.

While this system is fairly good, it still could stand some improvement. The ability to make a set of identically bitted keys that nonetheless have a master or grandmaster status could be improved on. In addition the key itself could be made somewhat stronger in spite of the various cutouts made in it.

OBJECTS OF THE INVENTION

It is therefore an object of the present invention to provide an improved flat key.

Another object is the provision of such an improved flat key which overcomes the above-given disadvantages, that is which can easily be set up for mastering and grandmastering and which is physically as strong as a simple-bitted key.

SUMMARY OF THE INVENTION

A key has according to the invention a flat key body having a blade extending along a longitudinal insert axis and having a front edge formed with transversely directed bitting, an opposite longitudinally extending back edge, and a pair of oppositely directed faces. Each face is formed with at least two longitudinally extending front grooves extending adjacent the front edge a full length of the blade and having depths equal to more than half of a transverse thickness of the blade, a longitudinally extending back groove having a floor at a depth equal to less than half of the blade thickness, and an elongated angled groove extending at an acute angle to and across the respective back groove at an intersection and having a part-cylindrical floor aligned with and forming a smooth continuation of the floor of the respective back groove at the intersection. The angled groove of the one face extends nonparallel to the angled groove of the other face, that is axes of the angled grooves on one face are all parallel to each other and cross similar axes of the grooves on the other face.

According to this invention the front groove closest to the back edge and the front groove closest to the front edge are the same across an entire series of keys and the other front grooves are of different cross-sectional shapes in the series.

Each face is formed in accordance with this invention with a plurality of such angled grooves extending parallel to one another. More particularly each face has two such pluralities each having at most five such angled grooves so that the key can have a maximum of twenty angled grooves.

According to another feature of the invention each of the angled grooves ends at a spacing from the back edge on the respective side face and each side face has a clear and uninterrupted land extending along the back edge.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
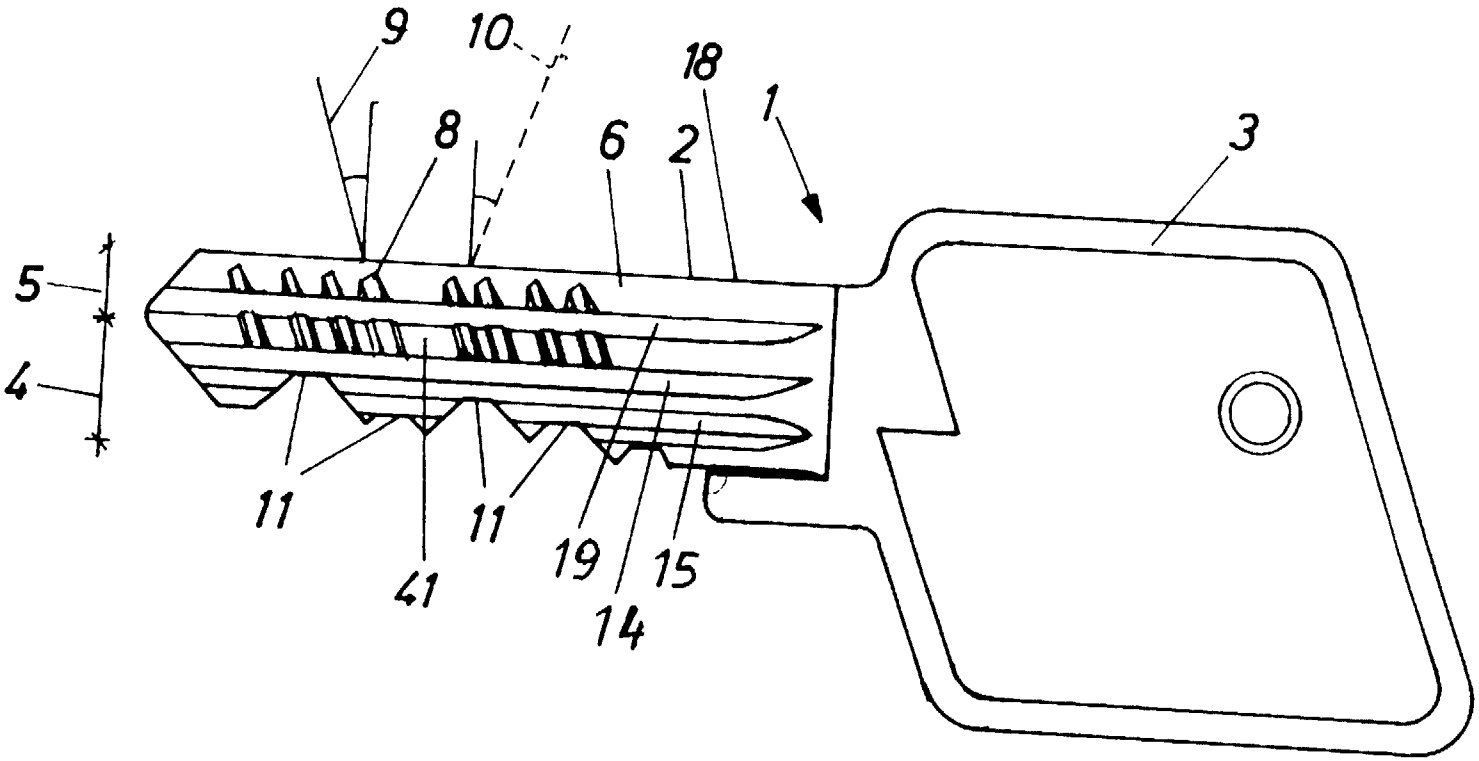
FIG. 1 is a side view of a key according to the invention.

As seen in FIG. 1 a key 1 according to this invention has a flat blade 2 and a bow 3 . The blade 2 has a front bitted edge region 4 and a back region 5 as well as a pair of oppositely directed and transversely extending side faces 6. Each side face 6 is formed with at least three longitudinally extending grooves 12, 13, 14, 15, 19, 20 (see FIG. 2 also) of uniform section and extending the full length of the blade 2, as well as with several angled transversely open grooves 8. The grooves 8 of one face 6 extend along lines 9 at a small acute angle to a perpendicular to the longitudinally extending blade 2 and the grooves 8 of the opposite face 6 extend along lines 10 that are inclined oppositely to cross the lines 9. The front edge region 4 is formed with standard bit cutouts 11.

Figure 2:
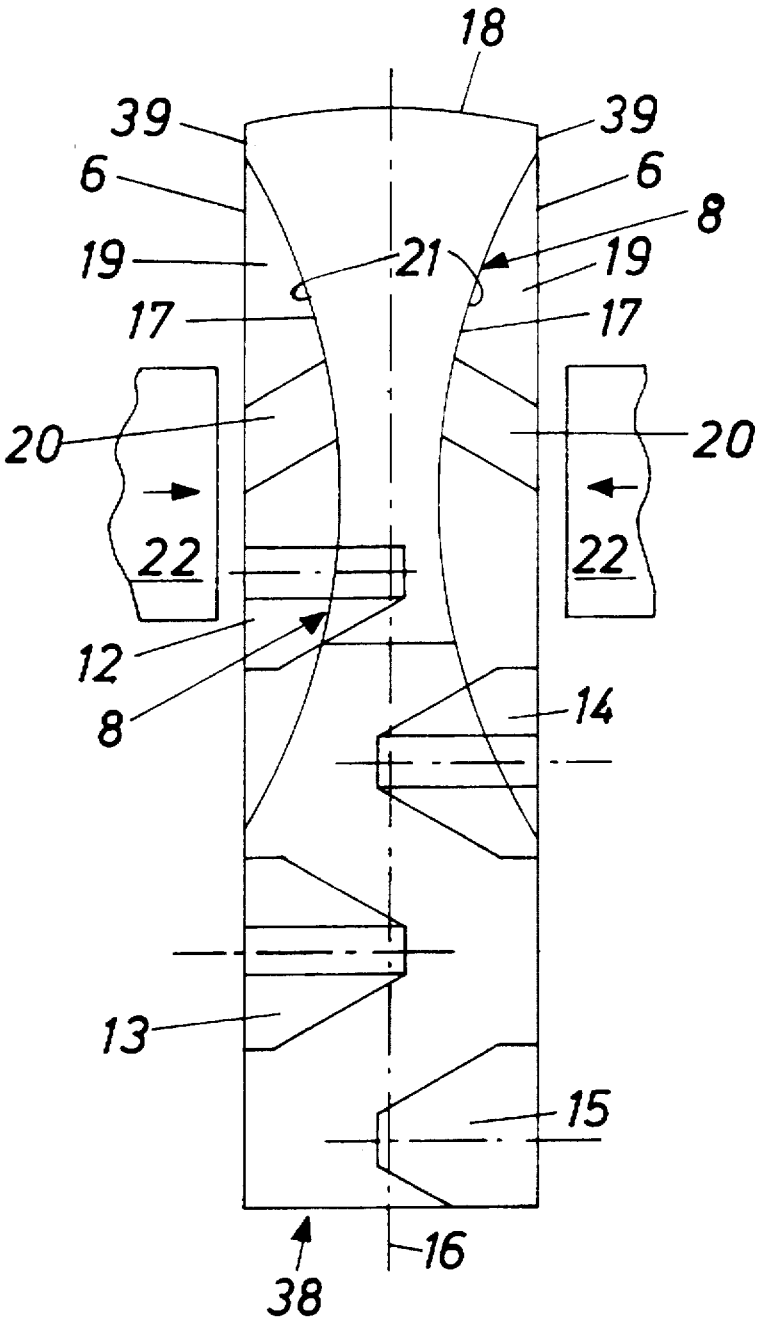
FIG. 2 is a diagram illustrating the orientation of the various formations of the key in accordance with this invention.

As better shown in FIG. 2, each groove 8 has a circularly arcuate or in fact part-cylindrical floor or base surface 17 that ends short of the longitudinal back edge 18 of the blade 2, leaving a clear land strip 39 extending the full length of the blade 2. The grooves 12, 13, 14, and 15, of which two are provided on each face 6, can be variously formed but are offset from one face 6 of the blade 2 to the other so that the floor of each such groove 12, 13, 14, or 15 is past a center symmetry plane 16 of the blade 2, that is the groove depth is greater than half the blade thickness.. Here for instance the groove 12 is of right-trapezoidal section with one side edge or flank that is perpendicular to the plane 16 while the other grooves 13 through 15 have flanks that are both angled. The grooves 19 and 20, of which at least one is provided on each face 6, have floors 21 that are exactly level with the floors 17 of the grooves 8, so that where they cross the floors run smoothly together.

Figure 3:
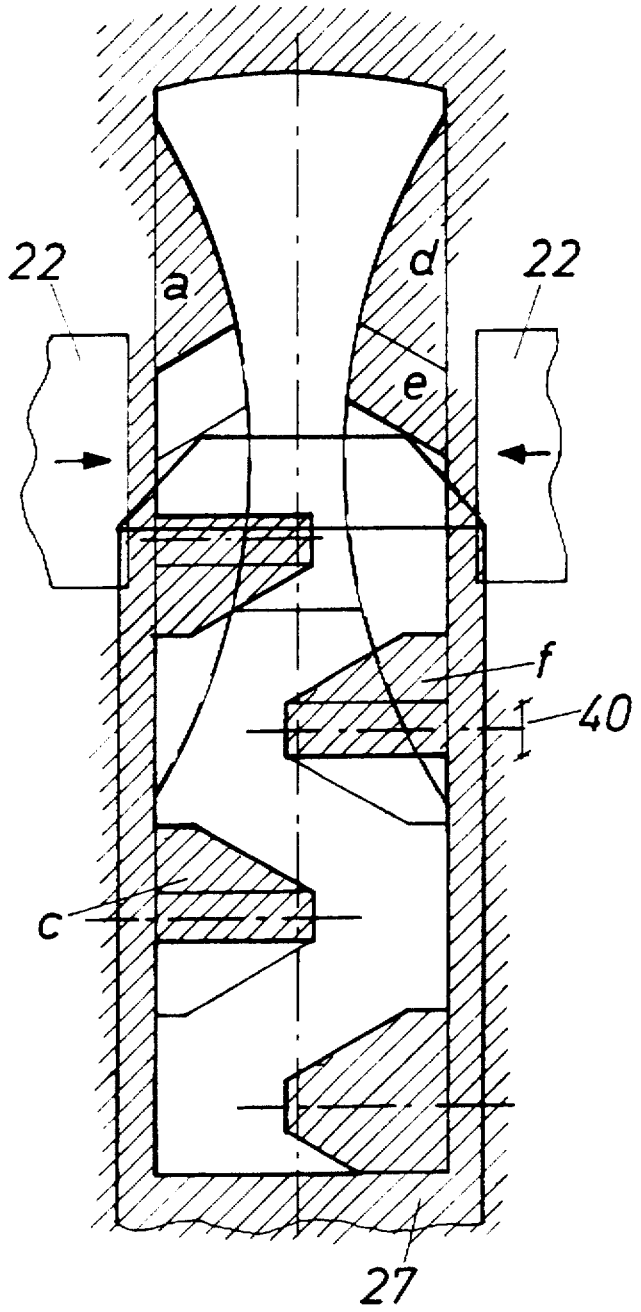
FIGS. 3 and 4 are sections through keys and locks according to the invention.
Figure 4:
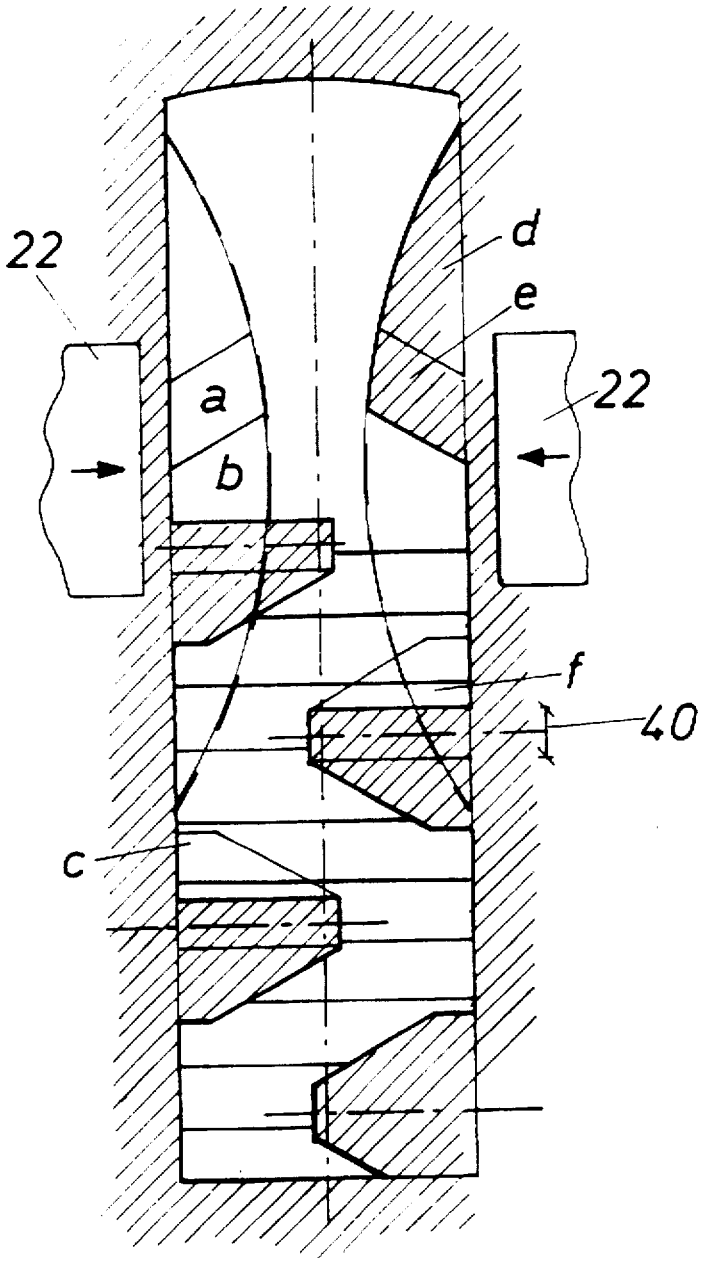
Figure 5:
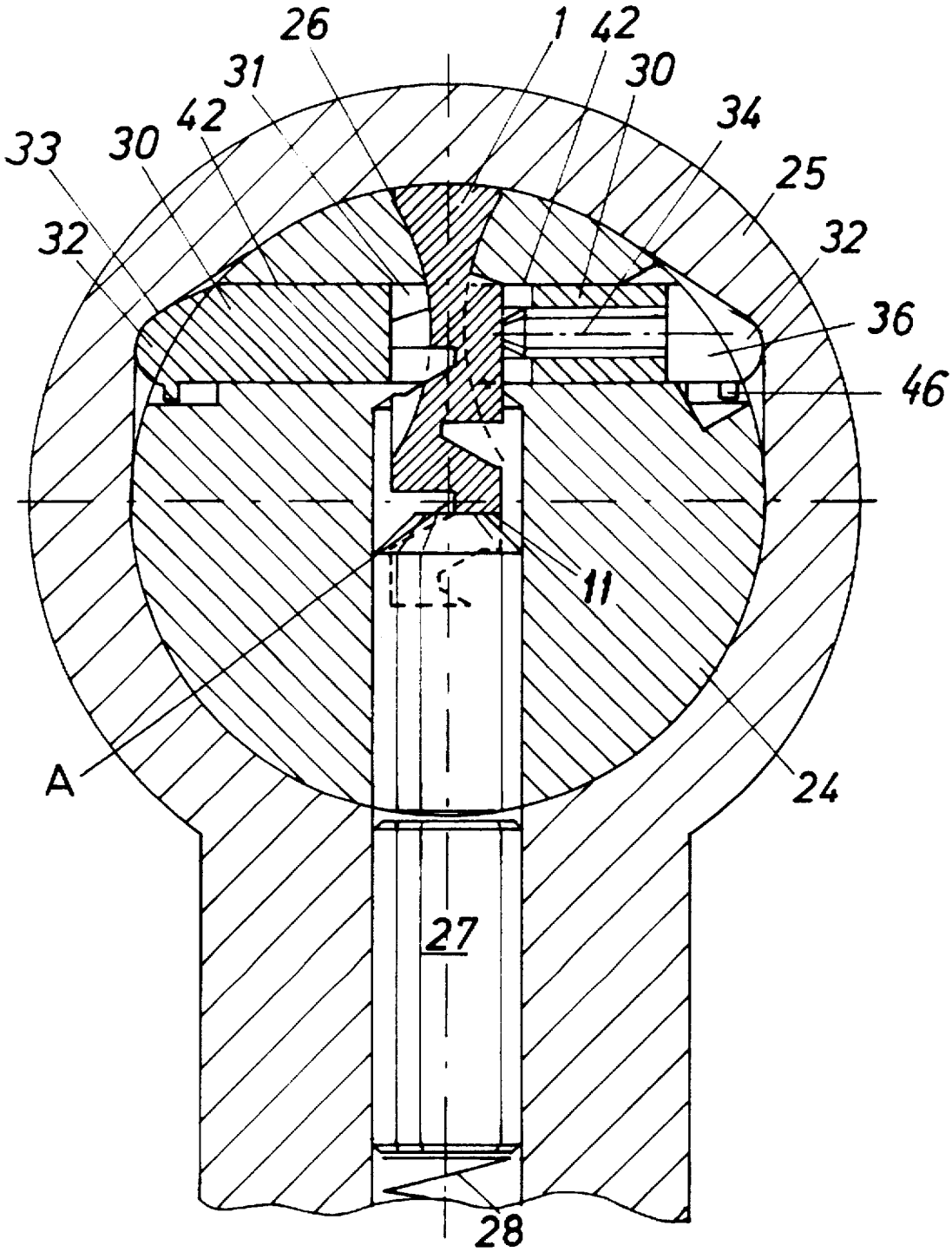
FIGS. 5, 6, and 7 are large-scale sections through locks according to this invention fitted with various keys.

FIGS. 3 and 4 show two different configurations. Here sections a, b, c, d, e, and f can be machined out or left in to differently form the grooves 12, 13, 14, 15, 19 and 20. In FIG. 3 the strips a, c, d, e, and f are machined off the key while in FIG. 4 strips d and e are all that are machined off the key. In any case at least a center strip 40 is left for each of the lower longitudinal grooves 12, 13, 14, and 15. As mentioned above the floors 21 of the grooves 19 and 20 are longitudinally aligned and flush with the floors 17 of the grooves 8. Auxiliary tumblers shown schematically at 22 can fit with the grooves 8 as described below. Normally the groove 12 closest to the back edge 18 and the groove 16 closest to the bit edge 11 are the same across a whole series of keys, but the two center grooves 13 and 14 can have their cross-sectional shapes differ so as to master or grand master the series of keys while keeping the bitting the same.

FIGS. 5 through 10 show a lock for the key according to this invention. It has a basically cylindrical core 24 rotatable about an axis A in a housing 25. The core 24 is formed with a passage 26 of a cross-sectional shape complementary to that of the key 1 to be inserted into it, and the housing 25 is provided with standard pin-type tumblers 27 urged by springs 28 into engagement with bitting 11 on the bottom edge of the key 1.

Figure 6:
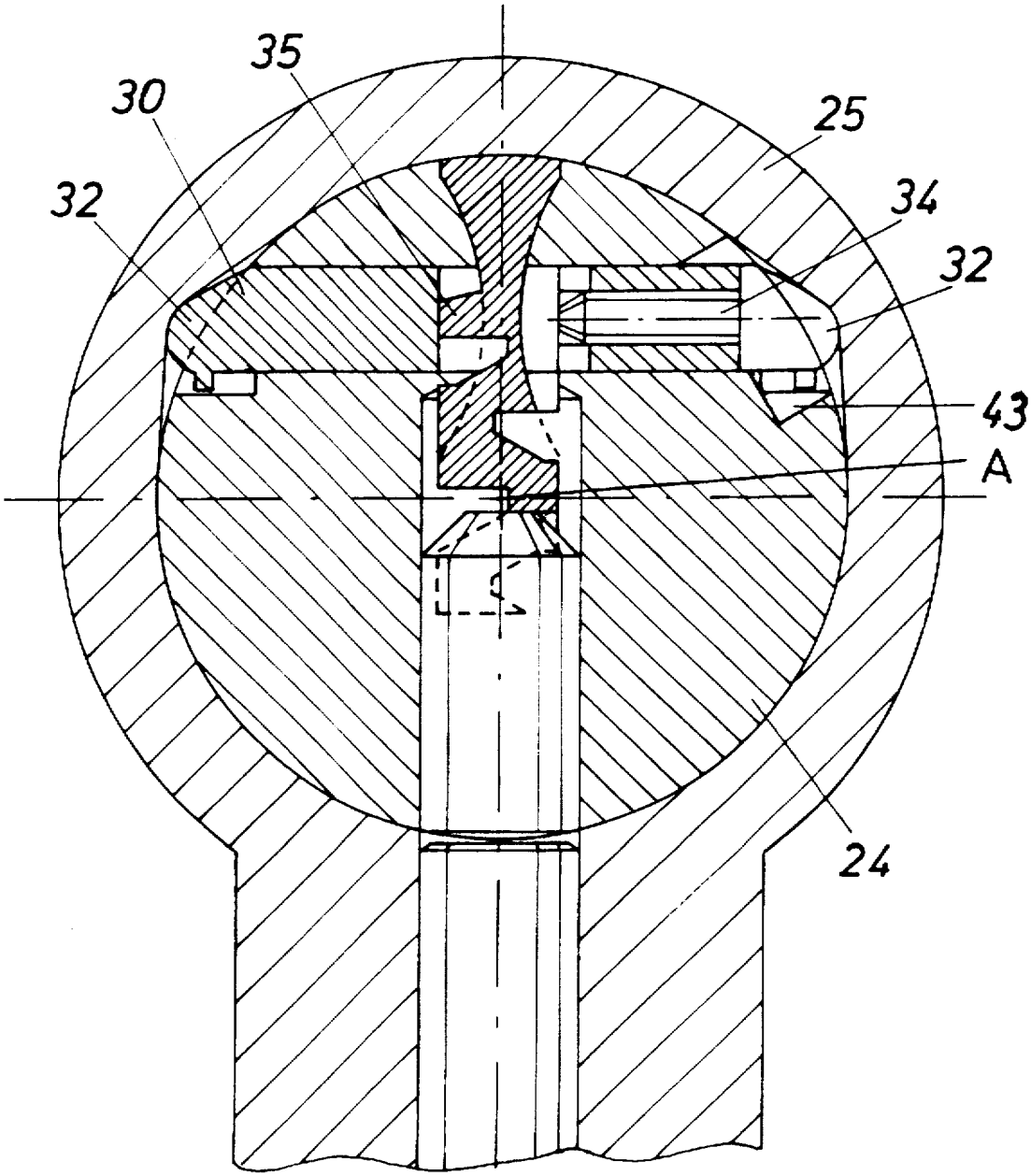

An auxiliary or secondary tumbler 30 has an outer end 32 engageable in a pocket or recess 33 of the housing 25 and an inner end 31 (see FIG. 8) which is formed to fit complementarily with the two sets of angled grooves 8 on the respective face 6 of the key blade 2. When the right key is in the passage 26, the tumbler 30 will be able to move in from the FIG. 5 position. When, however, a key with an interfering ridge 35 is inserted, as shown in FIG. 6 (where as in FIG. 5 the sections planes to the right and left of the center of the view are at different levels), the tumbler 30 cannot move in and the barrel 24 cannot rotate in the housing 25. The tumbler 30 has a lateral projection 46 that prevents it from dipping too deeply into the core 24, only moving in enough so that its head 32 is within the cylindrical surface defined by the outer surface of the core 24.

Figure 7:
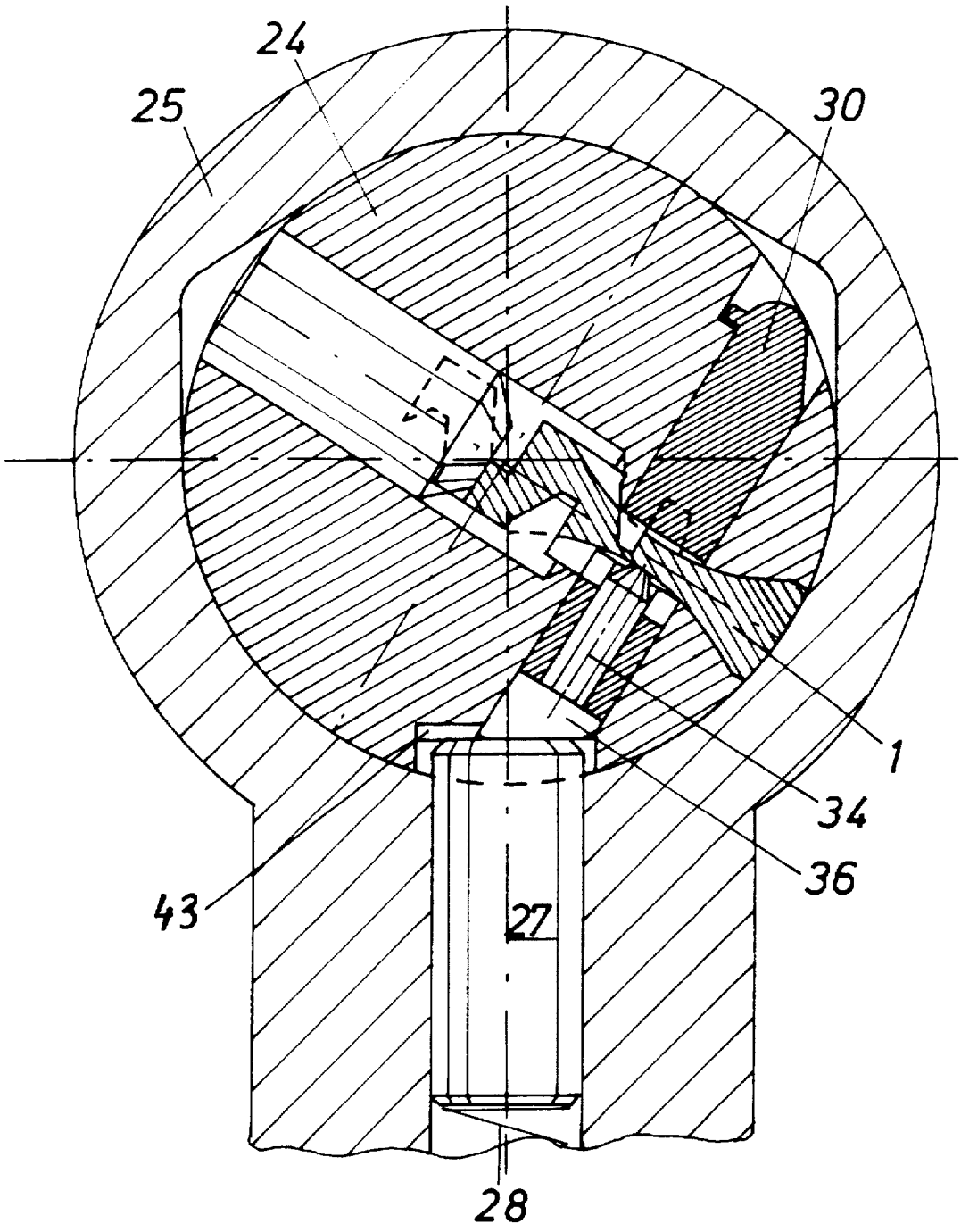
Figure 11:
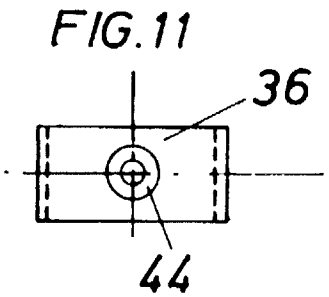
FIG. 11 is an end view of the structure of FIG. 10.
Figure 8:
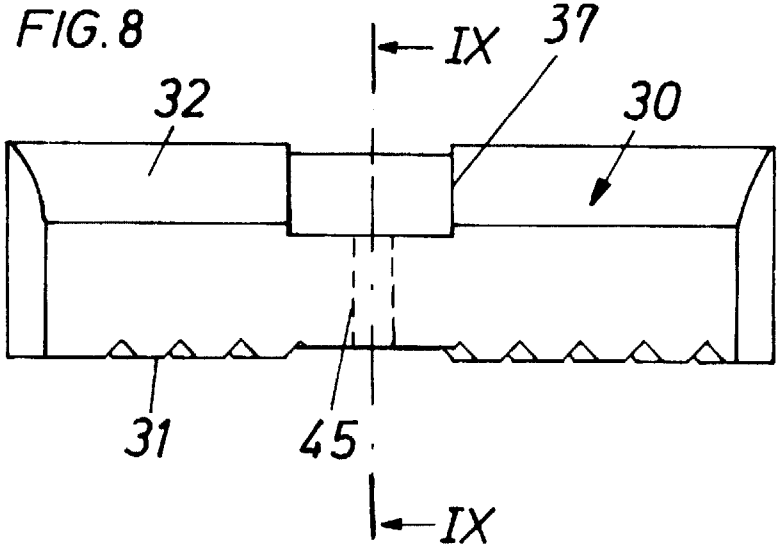
FIG. 8 is a side view of the auxiliary tumbler according to the invention.
Figure 10:
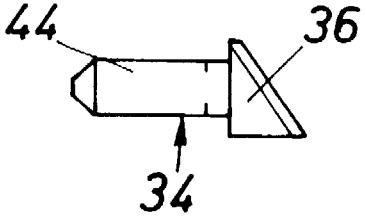
FIG. 10 is a side view of the control pin of the auxiliary tumbler.
Figure 9:
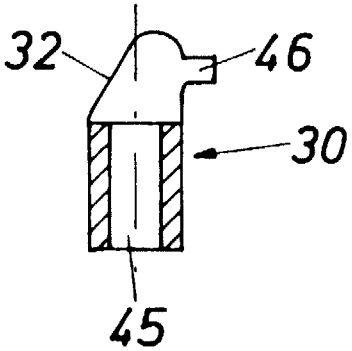
FIG. 9 is a section taken along line IX—IX of FIG. 8.

Each secondary tumbler 30, of which there are two, is provided centrally in a region level with a groove-free land 41 (FIG. 1) between the two sets of grooves 8 with a control element 34 having a head 36 fitting in a back notch and a shaft 44 riding in a passage 45 of the tumbler. The outer surface of the core 24 is formed at each tumbler 30 with a recess 43 that is substantially filled by the head 36 when the pin 45 bears on the raised land 41. When as shown in FIG. 7 a key 1 has been machined away with a large groove in both sides so the tumblers 30 can move radially in, the control element 34 will also move in and will allow a tumbler 27 to catch in the opening 43, preventing further rotation of the core 24. Thus only a key 1 with the proper grooves and formations can rotate the core 24.

I claim:

1. A key comprising:

a flat key body having a blade extending along a longitudinal insert axis, having a front edge formed with transversely directed bitting, an opposite longitudinally extending back edge, and a pair of oppositely directed side faces each formed with at least two longitudinally extending front grooves extending adjacent the front edge a full length of the blade and having depths equal to more than half of a transverse thickness of the blade, a longitudinally extending back groove having a floor at a depth equal to less than half of the blade thickness, and an elongated angled groove extending at an acute angle to and across the respective back groove at an intersection and having a part-cylindrical floor aligned with and forming a smooth continuation of the floor of the respective back groove at the intersection, the angled groove of one of the side faces extending nonparallel to and crossing the angled groove of the other of the side faces, each of the angled grooves ending at a spacing from the back edge on the respective side face and each side face having a clear and uninterrupted land extending along the back edge.

2. The key defined in claim 1 wherein each face is formed with a plurality of such angled grooves extending parallel to one another.

3. The key defined in claim 2 wherein each face has two such pluralities each having at most five such angled grooves, whereby the key can have a maximum of twenty angled grooves.

* * * * *